US009745816B2

(12) United States Patent
Milne et al.

(10) Patent No.: US 9,745,816 B2
(45) Date of Patent: Aug. 29, 2017

(54) METHOD OF SUBSEA CONTAINMENT AND SYSTEM

(71) Applicant: HELIX ENERGY SOLUTIONS GROUP, INC., Houston, TX (US)

(72) Inventors: Raymond Milne, The Woodlands, TX (US); William McDaniell, The Woodlands, TX (US)

(73) Assignee: Helix Energy Solutions Group, Inc., Houston, TX (US)

( * ) Notice: Subject to any disclaimer, the term of this patent is extended or adjusted under 35 U.S.C. 154(b) by 0 days.

(21) Appl. No.: 14/809,212

(22) Filed: Jul. 25, 2015

(65) Prior Publication Data

US 2016/0024867 A1 Jan. 28, 2016

Related U.S. Application Data

(60) Provisional application No. 62/029,161, filed on Jul. 25, 2014.

(51) Int. Cl.
*E21B 33/035* (2006.01)
*E21B 19/00* (2006.01)
(Continued)

(52) U.S. Cl.
CPC ..... *E21B 33/035* (2013.01); *E21B 19/002* (2013.01); *E21B 33/043* (2013.01); *E21B 33/076* (2013.01)

(58) Field of Classification Search
CPC .... E21B 19/002; E21B 33/035; E21B 33/064; E21B 33/043; E21B 33/068; E21B 33/076; E21B 21/001; E21B 37/00
See application file for complete search history.

(56) References Cited

U.S. PATENT DOCUMENTS 3,779,313 A * 12/1973 Regan ..... E21B 33/0415 166/208
3,837,684 A * 9/1974 Hynes ..... E21B 33/043 285/123.12
(Continued)

FOREIGN PATENT DOCUMENTS

WO WO 95/16102 * 5/1995 ..... E21B 19/002

OTHER PUBLICATIONS

Rhee, PCT Search Report for PCT Application No. PCT/US15/42151 dated Oct. 6, 2015.
(Continued)

*Primary Examiner* — James G Sayre
(74) *Attorney, Agent, or Firm* — Locke Lord LLP

(57) ABSTRACT

A method and system of subsea containment which includes the steps of lowering the running tool into a subsea containment system, wherein the subsea containment system comprises an annular preventer, engaging the running tool to a target, closing the annular preventer, pulling up the target, and circulating fluid about the target. In a preferred method, rotating the running tool, cutting tubing, circulating the fluid at of the circulation line through the outlet, pulling the running tool out of the subsea containment system, and/or opening the annular preventer also performed. The target may be any item found in a subsea environment including a tubing hanger, a casing hanger, a tubing, a seal assembly, a component of a wellhead, or a component of the downhole completion.

19 Claims, 7 Drawing Sheets

(51) Int. Cl.
*E21B 33/043* (2006.01)
*E21B 33/076* (2006.01)

(56) References Cited

U.S. PATENT DOCUMENTS

| | | | | | |
|---|---|---|---|---|---|
| 4,053,023 | A | | 10/1977 | Herd et al. | |
| 4,378,849 | A | | 4/1983 | Wilks | |
| 5,944,111 | A | | 8/1999 | Bridges | |
| 5,961,094 | A | * | 10/1999 | Van Winkle | E21B 23/06 166/277 |
| 5,988,277 | A | * | 11/1999 | Vick, Jr. | E21B 23/04 166/123 |
| 6,039,119 | A | * | 3/2000 | Hopper | E21B 33/03 166/348 |
| 6,918,446 | B2 | * | 7/2005 | Borak, Jr. | E21B 33/035 166/338 |
| 9,157,291 | B2 | * | 10/2015 | Favilli | E21B 33/02 |
| 2012/0037374 | A1 | * | 2/2012 | Schuurman | E21B 33/064 166/340 |
| 2012/0152561 | A1 | * | 6/2012 | Herbel | E21B 29/08 166/360 |
| 2012/0217020 | A1 | | 8/2012 | Edwards et al. | |
| 2013/0175044 | A1 | * | 7/2013 | Telfer | E21B 17/1007 166/358 |
| 2015/0184477 | A1 | * | 7/2015 | Vestavik | E21B 7/20 166/381 |

OTHER PUBLICATIONS

Rhee, PCT Written Opinion for PCT Application No. PCT/US15/42151 dated Oct. 6, 2015.

* cited by examiner

METHOD OF SUBSEA CONTAINMENT AND SYSTEM

CROSS REFERENCE TO RELATED APPLICATIONS

This nonprovisional application for patent claims priority to, and hereby incorporates by reference, U.S. Provisional Application Ser. No. 62/029,161, entitled "Tooling and Method," filed Jul. 25, 2014.

BACKGROUND OF THE INVENTION

Technical Field of Invention

The invention disclosed and taught herein relates generally to a system and method for use in floating offshore environments including drilling rigs. The embodiments described below related generally to the design layout of equipment used on a subsea wellhead system or subsea tree system related to an environmental containment system for the same.

Description of Related Art

In the offshore drilling environment, pollution from in-hole work being performed is an environmental concern. For example, in plugging and abandonment (P&A) operations, it is important to ensure contaminates such as hydrocarbons, oil based muds, and hazardous brines are not unintentionally released to the environment. When a well barrier is removed in open water operations, there is a chance that a small amount of trapped hydrocarbons or contaminates could be released into the ocean. This typically would not be associated with sustained flow from the well.

Upper abandonments are typically performed with a riser based subsea blowout preventer stack (BOP) or Intervention Riser System (IRS). The riser is a conduit that enables tools and fluids to be passed from the surface rig to the subsea well. This provides a physical barrier to the environment. In some cases, the upper abandonment of a well entails the removal of the upper sections of tubing and casing strings. The outside diameter of these strings and associated hangers often prohibit the use of an IRS. The work can be performed without the use of a riser (riserless), but other means of environmental barriers must be used in place of the riser. Therefore, a need exists to provide method and system to meet this objective. Prior to performing an upper abandonment, the hydrocarbon bearing production zones will have been sealed with cement plugs. In current practice, at least two tested barriers will have been placed in full compliance with local regulations.

SUMMARY OF THE INVENTION

The present invention relates to a method and system of subsea containment which includes the steps of lowering the running tool into a subsea containment system, wherein the subsea containment system comprises an annular preventer, engaging the running tool to a target, closing the annular preventer, pulling up the target, and circulating fluid about the target. In a preferred method, rotating or hydraulically functioning the running tool, cutting tubing, circulating the fluid at of the circulation line through the outlet, pulling the running tool out of the subsea containment system, and/or opening the annular preventer also performed. The target may be any item found in a subsea environment including a tubing hanger, a casing hanger, a tubing, a seal assembly a component of a wellhead, or a component of the downhole completion.

The present invention is described in terms of pulling a tubing hanger with a running tool, but those skilled in the art will recognize the advantages of this invention can be adapted to tubing, casing, single and multi-operations, and other aspects related to a subsea tree, tubing head, wellhead, or downhole equipment. Pulling casing strings and seal assemblies, circulating out mud or brines, cleaning tubing and casing, casing or tubing remediation, workover operations, and similar operations are considered to be within the scope of the invention.

DESCRIPTION OF THE DISCLOSED EMBODIMENTS

Figure 1:
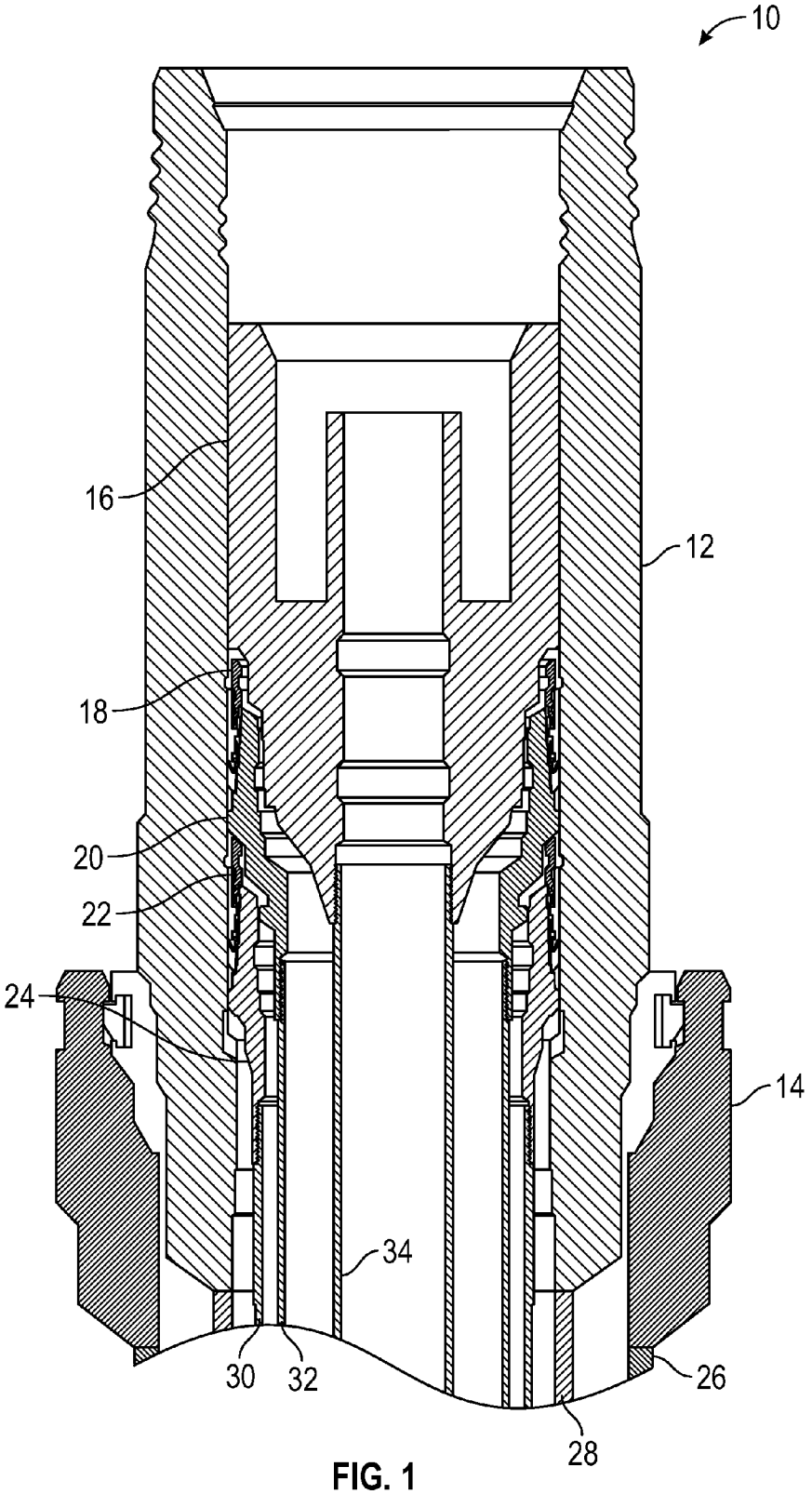
FIG. 1 shows a side, cross sectional diagram of a wellhead system.

The drawings described above and the written description of specific structures and functions below are presented for illustrative purposes and not to limit the scope of what has been invented or the scope of the appended claims. Nor are the drawings drawn to any particular scale or fabrication standards, or intended to serve as blueprints, manufacturing parts list, or the like. Rather, the drawings and written description are provided to teach any person skilled in the art to make and use the inventions for which patent protection is sought. Those skilled in the art will appreciate that not all features of a commercial embodiment of the inventions are described or shown for the sake of clarity and understanding.

Persons of skill in this art will also appreciate that the development of an actual, real-world commercial embodiment incorporating aspects of the inventions will require numerous implementation specific decisions to achieve the developer's ultimate goal for the commercial embodiment. Such implementation specific decisions may include, and likely are not limited to, compliance with system related, business related, government related and other constraints, which may vary by specific implementation, location and from time to time. While a developer's efforts might be complex and time consuming in an absolute sense, such efforts would nevertheless be a routine undertaking for those of skill in this art having the benefit of this disclosure.

It should also be understood that the embodiments disclosed and taught herein are susceptible to numerous and various modifications and alternative forms. Thus, the use of a singular term, such as, but not limited to, "a" and the like, is not intended as limiting of the number of items. Similarly, any relational terms, such as, but not limited to, "top," "bottom," "left," "right," "upper," "lower," "down," "up,"

"side," and the like, used in the written description are for clarity in specific reference to the drawings and are not intended to limit the scope of the invention or the appended claims.

The first operation after removing the IRS would be to pull the tubing and tubing hanger (upper completion). In order to confidently predict what lies behind the production casing it is necessary to remove the tubing and then use logging tools (or other means) to discover what is behind one steel barrier with accuracy. Immediately below the Tubing Hanger (TH) there is a possibility of trapped hydrocarbons which cannot be circulated out using conventional means. There is also potential in wells for hazardous mud or brines in the tubing/casing annulus.

The accompanying drawings will help in showing how the containment system is deployed and operated. The purpose of the shear rams is to secure the well in the event of a Dynamic Positioning (DP) drive off or failure. The annular element forms a seal around the drill pipe which allows the fluids inside the well to be contained and circulated out in a controlled manner.

As shown in FIG. 1, a wellhead system 10 includes a high pressure wellhead 12. The high pressure wellhead 12 is shown in contact with a conductor wellhead 14. A tubing hanger 16 is shown in the wellhead 12. The tubing hanger is shown in the wellhead for the purpose of simplicity, but could also be located in a subsea tree or tubing head spool (THS). While the invention is described with relation to engaging and removing a tubing hanger 16 with a running tool 68, any target that can be engaged with the running tool is considered to be within the scope of the invention. This may include the present invention is described in terms of pulling a running tool, but those skilled in the art will recognize the advantages of this invention can be adapted to any target including tubing, casing, single and multi-operations, and other aspects related to a subsea tree, tubing head, wellhead or downhole equipment. Pulling casing strings and seal assemblies, circulating out mud or brines, cleaning tubing and casing, casing or tubing remediation, workover operations, and similar operations are considered to be within the scope of the invention.

The tubing hanger 16 is in contact with a production casing hanger 20. The production casing hanger 20 is in contact with a production casing hanger seal assembly 18. The production casing hanger 20 is also in contact with an intermediate casing hanger 24. The intermediate casing hanger 24 is in contact with an intermediate casing hanger seal assembly 22.

As shown, there is conductor casing 26, surface casing 28, intermediate casing 30, and production casing 32. Additionally there is production tubing 34.

The tubing hanger 16 is in contact with the production tubing 34. The casing hanger 20 is in contact with the casing 32, while the casing hanger 24 is in contact with the casing 30 The high pressure wellhead 12 is in contact with casing 28 and the conductor wellhead is in contact with casing 26.

Figure 2:
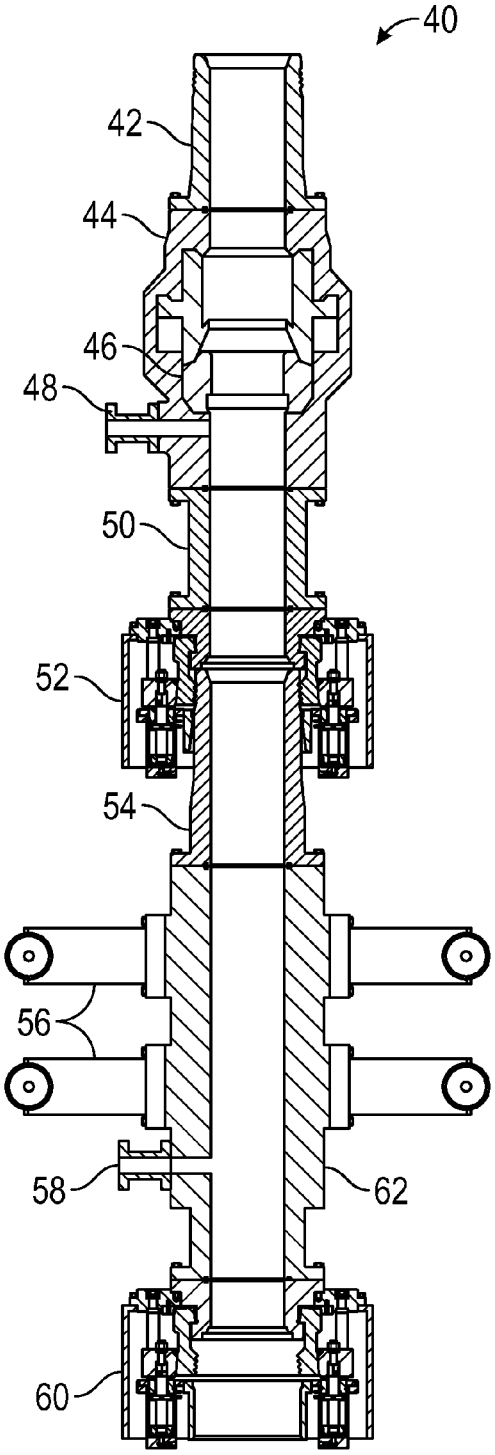
FIG. 2 shows a side, cross sectional diagram of a containment system stack up.

FIG. 2 shows an embodiment of the containment system 40. As shown, the containment system 40 contains a re-entry mandrel 42. The re-entry mandrel 42 is connected to the rest of the containment system 40 by an annular preventer 44. The annular preventer 44 contains a sealing element 46.

As shown, the containment system 40 contains an outlet 48. In order to ensure trapped pockets of contaminants and gases can be circulated out effectively, outlet should be located as close as possible to the sealing element 46 of the annular preventer 44. Downstream of the outlet, a series of valves (these valves could include a variety of types and actuation methods) may be included to serve as mechanical barriers.

The outlet may be formed to be a receptacle for such devices as a remotely operated vehicle (ROV) hotstab or alternate subsea makeable connection. Alternatively, the outlet 48 along with outlet 58, could be routed to a common manifold with a series of valves (these valves could include a variety of types and actuation methods). This would enable a single connection point for a circulation line to surface.

The containment system 40 preferably also contains a spool 50 in contact with the annular preventer 44 and could include such types of connector 52 not limited to wellhead or high angle release style. The spool piece would be interchangeable or possibly removed altogether depending on specific needs of an operation. The connector 52 connects to a re-entry mandrel 54. The re-entry mandrel profile would be identical to a wellhead or tree profile to enable a BOP stack to land on the re-entry mandrel 54 for well control contingency.

The re-entry mandrel 54 is also connected to a dual shear seal ram block 62, which is shown as having dual rams 56. Another outlet 58 is shown formed in the dual ram block 62. Like the outlet 48, it could also be routed to a series of valves or to a common manifold. Downstream of the valves, the outlet could be formed an ROV hotstab or alternate subsea makeable connection. This outlet allows a user to monitor the pressure of the containment system 40 below the dual ram block 62 and could provide a means to test barriers below the shear rams Moreover, the containment system 40 may contain at least one wellhead connector 60. The connector is interchangeable in order to accommodate a variety of wellhead and tree systems.

Figure 3:
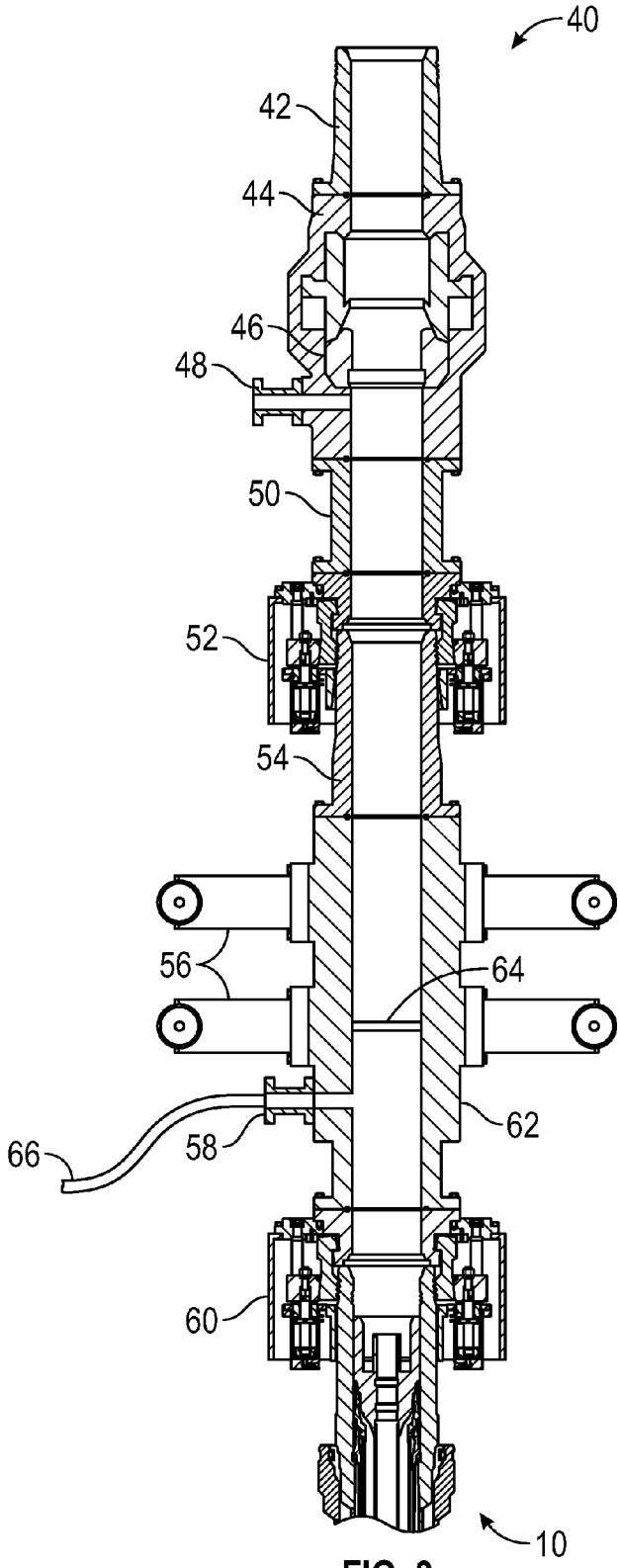
FIG. 3 shows a side, cross sectional diagram of a containment system deployed to a wellhead system.

As shown in FIG. 3, the containment system 40 as disclosed in FIG. 2 is being shown being deployed. In this embodiment, the containment system 40 is deployed on a wellhead system 10. Alternatively it could be landed on a subsea tree or tubing head spool. In a typical deployment, the containment system can be deployed with a subsea construction crane or alternatively on drill pipe. Once it is landed on the wellhead or tree system. It is locked onto the tree or wellhead using an ROV or alternatively using a subsea control system utilizing a single type or combination of communication methods not limited to electric, hydraulic, fiber optic, or acoustic signals.

A line 66 to the surface is connected to outlet 58 or alternate manifold and a lower shear ram 64 is put in a closed position. The line 66 is preferably a suitable length of coiled tubing but may alternatively be jointed pipe or other means of hose or rigid conduit. The wellhead system or tree is pressure tested using the line 66 to surface. Alternatively, the wellhead or tree may be tested using a dedicated test line in the umbilical or via ROV hotstab or alternate subsea makeable connection. Umbilical(s) containing a variety of cables and hoses used for fluid supply, electric power, and communication would also extend to surface. The umbilical could be self-supporting or clamped to pipe, buoyancy modules, or wire in order to support its weight.

It is useful to have accumulator bottles of sufficient capacity to operate all of the hydraulic functions in the containment system 40. The accumulators are filled with hydraulic control fluid from either a surface or subsea hydraulic power unit (HPU). Compressed gas in the accumulator bottle provides the energy to operate various hydraulically actuated equipment. Alternatively, some equipment could be actuated electrically or by intervention with an ROV.

Figure 4:
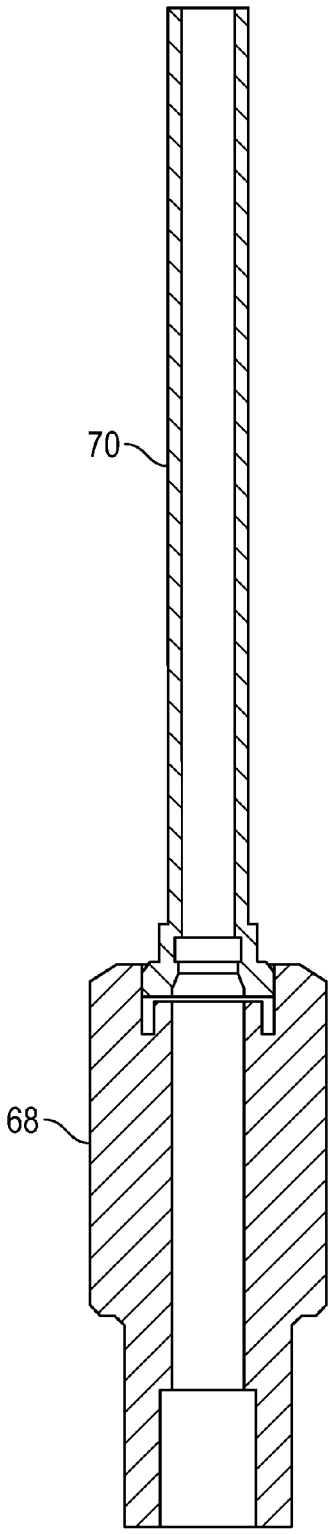
FIG. 4 shows a side, cross sectional diagram of a running tool and work string.
Figure 5:
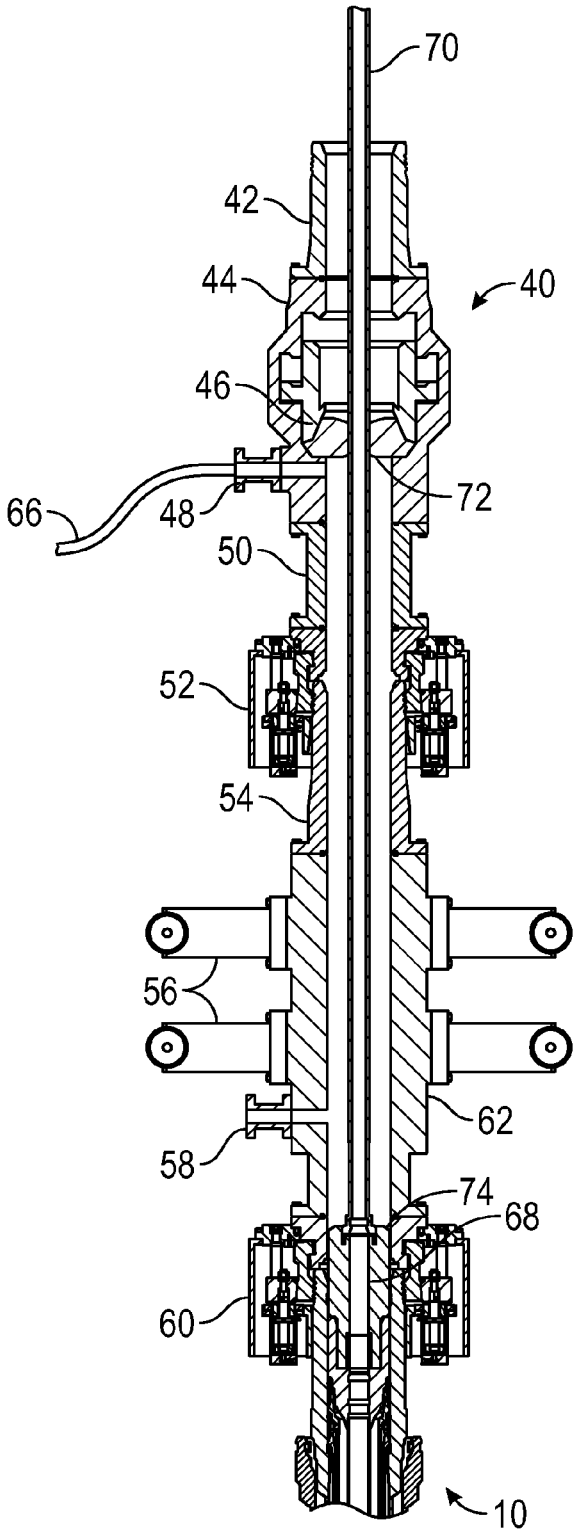
FIG. 5 shows a side, cross sectional diagram of a containment system with a running tool engaging a wellhead system.

FIG. 4. shows a running tool 68 on a work string 70 that can be use with the containment system 40. The running tool can be actuated using a combination of but not limited to hydraulic, electric, or mechanical means. The running tool on a work string 70 is deployed in open water and can then be lowered into the containment system 40 when at depth as shown in FIG. 5. The circulation line 66 can be moved to outlet 48 below the annular preventer 44. Alternatively, as previously stated, the circulation line might also be terminated at a manifold common to both outlet 48 and outlet 58.

The running tool 68 can then be lowered to engage the tubing hanger in the wellhead system 10 or other target. In a preferred embodiment, an active heave compensator is engaged until the running tool 68 engages the tubing hanger 16 of wellhead system 10 or other target. The annular preventer 44 is then closed and the running tool 68 can be rotated or otherwise actuated to fully engage the tubing hanger 16 of the wellhead system 10 or other target. It is preferable that the workstring in contact with the annular preventer sealing element 46 is clean, smooth, and coated with grease. When using a tool that requires control lines from surface, it is preferred to use a slick ported joint in order to provide a smooth sealing surface for the sealing element 46.

Figure 6:
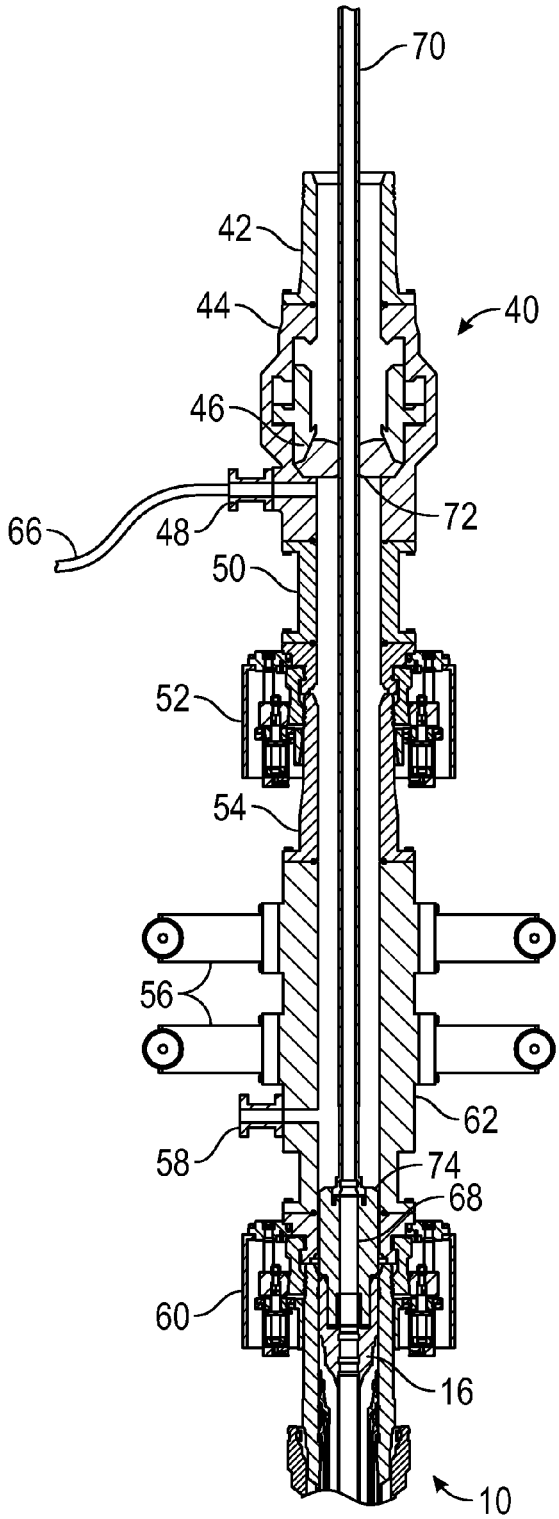
FIG. 6 shows a side, cross sectional diagram of a containment system in a preferred circulating mode.

As shown in FIG. 6, the running tool 68 can be pulled up by the work string 70 until a free path to circulate fluids is formed around the tubing hanger 16. During the circulation process, a section of pipe that can be sheared in case of emergency must be across the shear plane of the dual rams 56. If height constraints or other constraints prohibit circulation while the running tool 68 or tubing hanger 16 is below the shear rams, the work string can be raised until both are above the shear rams and below the annular preventer. A variety of spool sizes can be used to accommodate specific height constraints. The annular preventer 44 remains closed at bottom 72 about the work string 70. The work string 70 can be used to circulate water or other fluids through the tubing and annulus with returns being routed through the circulation line 66 connected to the outlet 48 to clean the tubing hanger 16 and production tubing 34. Circulation can continue until the returns are acceptably clean.

Figure 7:
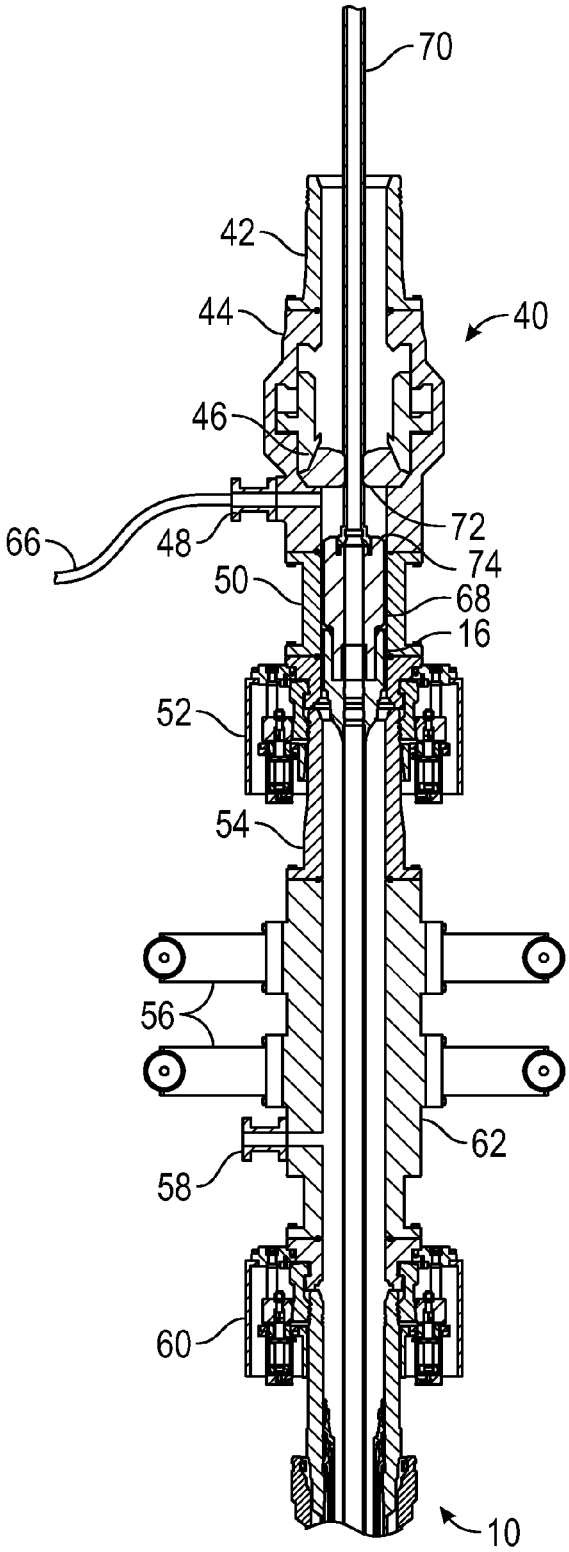
FIG. 7 shows a side, cross sectional diagram of a containment system in an alternate circulating mode.
Figure 8:
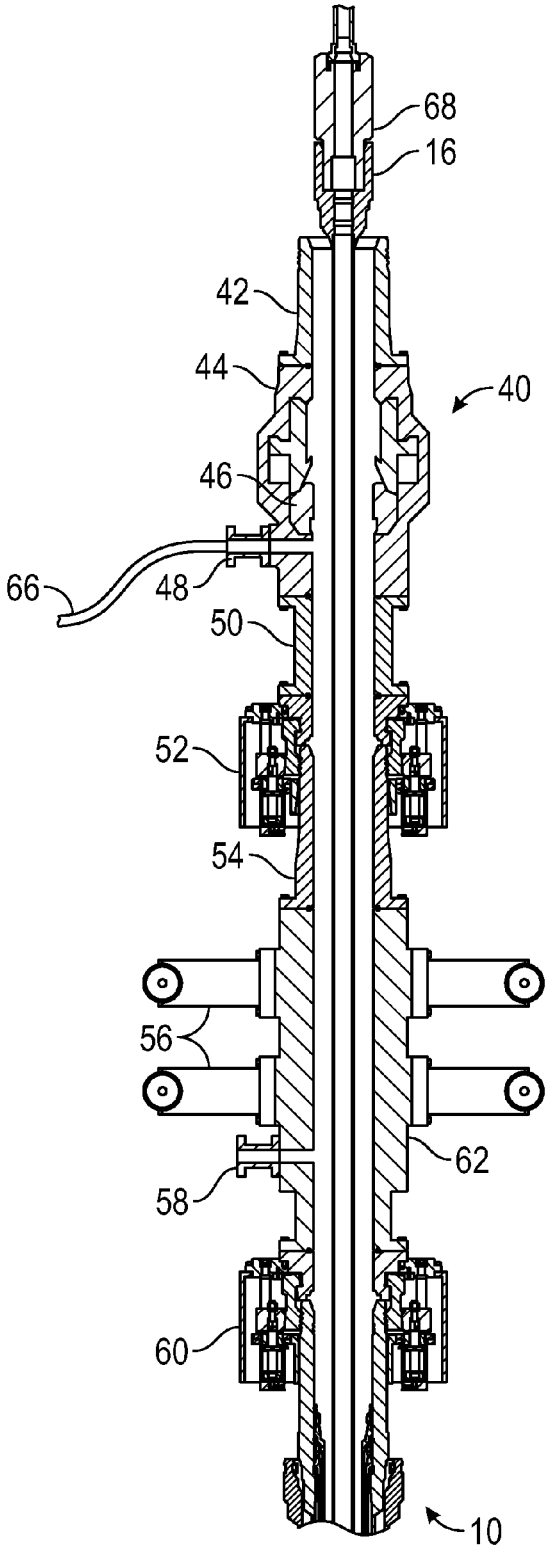
FIG. 8 shows a side, cross sectional diagram of a running tool and tubing hanger being lifted through a containment system.

FIG. 7 shows the running tool 68 being pulled up out of the containment system 40. After returns are acceptably clean, The pump can be shut down. It is expected that a flow check of the circulation line would be performed to ensure fluids originating in the well or formation are not flowing. Assuming there is no flow, the annular preventer 44 can be opened and the work string 70, running tool 68, tubing hanger 16, and cut production tubing 34 of the wellhead system 10 can be brought to the surface.

Following removal of the upper completion, specialized logging tools can be used to log the interval of interest in the production casing. Rig Up and run a Cast Iron Bridge Plug (CIBP) or other means of cement support and set above the cut tubing in the production casing 32. Then the user can pick up and Run in Hole with drill pipe or coiled tubing to the top of the cement support. In a preferred embodiment, a minimum volume of cement, as designated by local regulations, can be mixed and pumped in place on top of the CIBP. The drill pipe or coiled tubing can then be recovered to the surface.

Those skilled in the art will recognize the benefits of the invention may be used on more than pulling the tubing hanger and tubing. It is envisioned that the present invention may be used on pulling a casing hanger with seal assembly and casing. Casing hangers and casing will usually be set inside the wellhead or inside another string of casing.

When it has been determined where the casing can be cut and successfully pulled, deploy a tool or series of tools designed to cut and pull casing, casing hangers, and casing seal assemblies. This series of events can be performed in single or multiple trips. A work string is deployed to depth with a cutting tool, casing seal assembly pulling tool (CSAPT), a casing spear, or any combination of these or other tools. In some cases, the tools and equipment used will dictate the order of events for cutting and pulling a casing string, casing hanger, and a casing hanger seal assembly. The tools would be actuated by a variety of mechanical, electrical, or hydraulic means.

Once there is indication that the casing 32 is cut, the operator can shut down the pump and flow check the well. The operator would then pick up a combination of the tools, casing seal assembly, casing hanger, and casing string. Similarly to what is shown in FIG. 6, the tool 68 can be pulled up by the work string 70 until a free path to circulate fluids is formed around the casing hanger 20. During the circulation process, a section of pipe that can be sheared in case of emergency must be across the shear plane of the dual rams 56. If height constraints or other constraints prohibit circulation while the running tool 68 or casing hanger 20 is below the shear rams, the work string can be raised until both are above the shear rams and below the annular preventer. A variety of spool sizes can be used to accommodate specific height constraints. The annular preventer 44 remains closed at bottom 72 about the work string 70. The work string 70 can be used to circulate water or other fluids through the casing 32 and annulus with returns being routed through the circulation line 66 connected to the outlet 48 to clean the casing hanger 20 and casing 32. Circulation can continue until the returns are acceptably clean.

Upon successful flow check. The sealing element 46 can be opened. The operator can pick up on the drill string and pull the cut casing 32 to surface. Once the casing is clear of the wellhead deploy the Cement bond log (CBL) and log the interval of interest in the intermediate casing.

As previously stated, the present invention is described in terms of pulling a running tool, but those skilled in the art will recognize the advantages of this invention can be adapted to tubing, casing, single and multi-operations, and other aspects related to a wellhead system. Pulling casing strings and seal assemblies, circulating out mud or brines, cleaning tubing and casing, casing or tubing remediation, workover operations, and similar operations are considered to be within the scope of the invention.

While the invention has been described with reference to one or more particular embodiments, those skilled in the art will recognize that many changes may be made thereto without departing from the spirit and scope of the description. Each of these embodiments and obvious variations thereof is contemplated as falling within the spirit and scope of the claimed invention.

The invention claimed is:

1. A method of subsea containment which comprises the steps of:

(a) lowering a running tool into a subsea containment system, wherein the subsea containment system comprises an annular preventer;

(b) engaging the running tool to a target by rotating the running tool;

(c) closing the annular preventer;

(d) pulling up the target; and (e) circulating fluid about the target.

2. The method of claim 1 further comprising the step of cutting tubing after step (c).

3. The method of claim 1, wherein the subsea containment system further comprises an outlet and a circulation line, wherein step (e) further comprises circulating the fluid out of the circulation line through the outlet.

4. The method of claim 1 further comprising the step of opening the annular preventer after step (e).

5. The method of claim 1 further comprising the step of pulling the running tool out of the subsea containment system after step (e).

6. The method of claim 1 wherein the target is a tubing hanger.

7. The method of claim 1 wherein the target is a casing hanger.

8. The method of claim 1 wherein the target is a tubing.

9. The method of claim 1 wherein the target is a component of a wellhead.

10. The method of claim 1 wherein the target is a component of the downhole completion.

11. A subsea containment system comprising:

an annular preventer capable of being closed;

a running tool capable of being pulled up; and a circulation path in the subsea containment system;

wherein the running tool is capable of engaging a target by rotating the running tool; and wherein the circulation path is about the target when the running tool is pulled up and the annular preventer is closed.

12. The subsea containment system of claim 11 further comprising an outlet; and a circulation line in connection with the outlet.

13. The subsea containment system of claim 12 wherein the outlet comprises a hotstab or alternate subsea makeable connection.

14. The subsea containment system of claim 11 further comprising at least one dual ram.

15. The subsea containment system of claim 11 further comprising a work string connected to the running tool.

16. The subsea containment system of claim 11 wherein the target is a tubing hanger.

17. The subsea containment system of claim 11 wherein the target is a casing hanger.

18. The subsea containment system of claim 11 wherein the target is a casing seal assembly.

19. The subsea containment system of claim 11 wherein the target is a component of the downhole completion.

* * * * *